US007163066B2

(12) United States Patent
Lehr

(10) Patent No.: US 7,163,066 B2
(45) Date of Patent: Jan. 16, 2007

(54) GRAVITY VALVE FOR A DOWNHOLE TOOL

(75) Inventor: Douglas J. Lehr, The Woodlands, TX (US)

(73) Assignee: BJ Services Company, Houston, TX (US)

( * ) Notice: Subject to any disclaimer, the term of this patent is extended or adjusted under 35 U.S.C. 154(b) by 355 days.

(21) Appl. No.: 10/841,797

(22) Filed: May 7, 2004

(65) Prior Publication Data

US 2005/0257936 A1 Nov. 24, 2005

(51) Int. Cl.
*E21B 33/12* (2006.01)

(52) U.S. Cl. ..... 166/386; 166/106; 166/333.1

(58) Field of Classification Search ..... None
See application file for complete search history.

(56) References Cited

U.S. PATENT DOCUMENTS

| | | | | |
|---|---|---|---|---|
| 1,684,266 | A | 9/1928 | Fisher et al. | |
| RE21,677 | E | 12/1940 | Tremolada | 255/19 |
| 2,331,532 | A | 10/1943 | Bassinger | 166/12 |
| 3,076,509 | A | 2/1963 | Burns et al. | 166/70 |
| 3,299,955 | A | 1/1967 | Page, Jr. | 166/48 |
| 3,479,829 | A | 11/1969 | Goodman | 61/53.6 |
| 3,550,683 | A | 12/1970 | Corneaux | 166/156 |
| 3,687,196 | A | 8/1972 | Mullins | 166/217 |
| 3,720,264 | A | 3/1973 | Hutchinson | 166/311 |
| 3,727,691 | A | 4/1973 | Muecke et al. | 166/295 |
| 3,750,749 | A | 8/1973 | Giroux | 166/95 |
| 3,828,852 | A | 8/1974 | Delano | 166/78 |
| 3,867,984 | A | 2/1975 | Dufrene | 166/188 |
| 3,971,436 | A | 7/1976 | Lee | 166/70 |
| 4,151,875 | A | 5/1979 | Sullaway | 166/126 |

(Continued)

FOREIGN PATENT DOCUMENTS

EP 0498990 A1 8/1992

(Continued)

OTHER PUBLICATIONS

Halliburton's "FAS DRILL" product sheets (FAS DRILL® Frac Plug, © 1999 Halliburton Energy Services, Inc.; FAS DRILL® Squeeze Packers and Sliding-Valve Packers, © 1997 Halliburton Energy Services, Inc.; FAS DRILL® Bridge Plugs, © 1997 Halliburton Energy Services, Inc.).

(Continued)

*Primary Examiner*—Zakiya W. Bates
(74) *Attorney, Agent, or Firm*—Howrey LLP

(57) ABSTRACT

A gravity valve for a downhole tool for use in a subterranean well and a method of use thereof. The gravity valve is adapted to control the flow of a dowuhole fluid through the downhole tool. The gravity valve typically includes a plunger and a seat. The plunger may embody a substantially non-spherical end that is adapted to mate with a complementary receiving end on the seat. The increase surface area of contact between the plunger and the seat acts to improve the seal therebetween, reduce the stresses thereon, and improve the performance of the gravity valve in general. The components of the gravity valve may be constructed of materials, which are selected based on the specific gravity of the materials in comparison with the specific gravity of the downhole fluid for a given application. A method of constructing and utilizing a gravity valve for a downhole tool.

31 Claims, 8 Drawing Sheets

U.S. PATENT DOCUMENTS

| | | | | |
|---|---|---|---|---|
| 4,162,619 | A | 7/1979 | Nixon Jr. | 64/23 |
| 4,185,690 | A | 1/1980 | Kinney | 166/183 |
| 4,188,999 | A | 2/1980 | Amancharla | 166/133 |
| 4,190,111 | A | 2/1980 | Davis | 166/291 |
| 4,258,788 | A | 3/1981 | Patton et al. | 166/185 |
| 4,266,620 | A | 5/1981 | Wolgamott et al. | 175/215 |
| 4,313,497 | A | 2/1982 | Graham | 166/124 |
| 4,349,071 | A | 9/1982 | Fish | 166/124 |
| 4,393,930 | A | 7/1983 | Ross et al. | 166/188 |
| 4,401,161 | A | 8/1983 | Warren | 166/178 |
| 4,427,065 | A | 1/1984 | Watson | 166/250 |
| 4,436,150 | A | 3/1984 | Barker | 166/131 |
| 4,467,867 | A | 8/1984 | Baker | 166/188 |
| 4,478,286 | A | 10/1984 | Fineberg | 166/324 |
| 4,479,548 | A | 10/1984 | Gilbert | 166/387 |
| 4,520,879 | A | 6/1985 | MacElvain | 173/57 |
| 4,589,495 | A | 5/1986 | Langer et al. | 166/383 |
| 4,646,829 | A | 3/1987 | Barrington et al. | 166/125 |
| 4,708,202 | A | 11/1987 | Sukup et al. | 166/123 |
| 4,722,389 | A | 2/1988 | Arnold | 166/70 |
| 4,796,707 | A | 1/1989 | Halbardier | 166/387 |
| 4,834,184 | A | 5/1989 | Streich et al. | 166/376 |
| 4,836,279 | A | 6/1989 | Freeman | 166/153 |
| 4,972,908 | A | 11/1990 | Braddick | 166/387 |
| 4,986,361 | A | 1/1991 | Mueller et al. | 166/381 |
| 5,020,597 | A | 6/1991 | Braddick et al. | 166/291 |
| 5,048,612 | A | 9/1991 | Cochran | 166/382 |
| 5,117,915 | A | 6/1992 | Mueller et al. | 166/381 |
| 5,181,571 | A | 1/1993 | Mueller et al. | 166/381 |
| 5,211,224 | A | 5/1993 | Bouldin | 166/63 |
| 5,224,540 | A | 7/1993 | Streich et al. | 166/118 |
| 5,271,468 | A | 12/1993 | Streich et al. | 166/387 |
| 5,318,131 | A | 6/1994 | Baker | 166/382 |
| 5,332,038 | A | 7/1994 | Tapp et al. | 166/278 |
| 5,390,737 | A | 2/1995 | Jacobi et al. | 166/184 |
| 5,413,172 | A | 5/1995 | Laurel | 166/153 |
| 5,449,040 | A | 9/1995 | Milner et al. | 166/382 |
| 5,451,084 | A | 9/1995 | Jansch | 294/1.1 |
| 5,540,279 | A | 7/1996 | Branch et al. | 166/118 |
| 5,669,448 | A | 9/1997 | Minthorn et al. | 166/308 |
| 5,701,959 | A | 12/1997 | Hushbeck et al. | 166/387 |
| 5,829,531 | A | 11/1998 | Hebert et al. | 166/382 |
| 5,839,515 | A | 11/1998 | Yuan et al. | 166/387 |
| 5,865,251 | A | 2/1999 | Rebardi et al. | 166/278 |
| 5,984,007 | A | 11/1999 | Yuan et al. | 166/134 |
| 6,167,963 | B1 | 1/2001 | McMahan et al. | 166/179 |
| 6,220,348 | B1 | 4/2001 | Serafin et al. | 166/133 |
| 6,220,349 | B1 | 4/2001 | Vargus et al. | 166/138 |
| 6,244,642 | B1 | 6/2001 | Serafin et al. | 294/86.17 |
| 6,311,778 | B1 | 11/2001 | Carisella et al. | 166/382 |
| 6,354,372 | B1 | 3/2002 | Carisella et al. | 166/118 |
| 6,390,190 | B1 | 5/2002 | Mullins | 166/90.1 |
| 6,394,180 | B1 | 5/2002 | Berscheidt et al. | 166/193 |
| 6,491,108 | B1 | 12/2002 | Slup et al. | 166/387 |
| 6,491,116 | B1 | 12/2002 | Berscheidt et al. | 175/57 |
| 6,578,633 | B1 | 6/2003 | Slup et al. | 166/118 |
| 6,581,681 | B1 | 6/2003 | Zimmerman et al. | 166/135 |
| 6,708,768 | B1 | 3/2004 | Slup et al. | 166/382 |
| 6,708,770 | B1 | 3/2004 | Slup et al. | 166/387 |
| 2002/0029880 | A1 | 3/2002 | Slup et al. | 166/118 |
| 2002/0066577 | A1 | 6/2002 | Dewey et al. | 166/382 |
| 2002/0096365 | A1 | 7/2002 | Berscheidt et al. | 175/57 |
| 2004/0045723 | A1 | 3/2004 | Slup et al. | 166/386 |

FOREIGN PATENT DOCUMENTS

| | | |
|---|---|---|
| WO | WO01/09480 | 8/2001 |

OTHER PUBLICATIONS

Baker, "A Primer of Oilwell Drilling", Sixth Edition, published by Petroleum Extension Service in cooperation with International Association of Drilling Contractors, 2001; first published 1951.

Long, Improved Completion Method for Mesaverde-Meeteetse Wells in the Wind River Basin, SPE 60312, Copyright 1999.

Savage, "Taking New Materials Downhole—The Composite Bridge Plug", PNEC 662,935 (1994).

Guoynes, "New Composite Fracturing Plug Improves Efficiency in Coalbed Methane Completions" SPE 40052, Copyright 1998.

Baker Hughes' web page for "QUIK Drill™ Composite Bridge Plug" (Jul. 16, 2002).

Website printout "ServaMAP Frac Plug Model FPE" www.mapoiltools.com printed Nov. 22, 2002.

Website printout "Mod A Ball Check Cement Retainer" www.alphatx.com printed Nov. 22, 2002.

"Big Bore Frac Plug" Alpha Oil Tools, 1996, 1997.

"QUIK Drill Composite Frac Plug" Baker Oil Tools; Copyright 2002 Baker Hughes Incorporated.

Baker Service Tools Catalog, p. 26, [date unknown] "Compact Bridge Plug Model P-1."

Baker Service Tools Catalog, p. 6, Unit No. 4180, Apr. 26, 1985, "E-4 Wireline Pressure Setting Assembly."

Baker Oil Tools Catalog, 1998, "Quik Drill Composite Bridge Plug."

Baker Service Tools Catalog, p. 26, [date unknown] "Model T Compact Wireline Bridge Plug."

Baker Service Tools Catalog, p. 24 [date unknown] "Model S, N-1, and NC-1 Wireline Bridge Plugs."

Society of Petroleum Engineers Article SPE 23741; © 1992.

Baker Sand Control Catalog for Gravel Pack Systems; © 1988.

Offshore Technology Conference papers OTC 7022, "Horizontal Well Completing, Oseberg Gamma North," Bjorkeset et al.; © 1992.

"Water-packing Techniques Successful in Gravel Packing High-Angle Wells," Douglas J. Wilson and Mark F. Barrilleaux, Oil and Gas Journal © 1991.

Baker Prime Fiberglass Packer Prod. 739-09 data sheet.

Jun. 1968 World Oil Advertisement, p. 135 for Baker All-Fiberglass Packer.

Society of Plastics, www.socplas.org.

"Tape-laying precision industrial shafts", by Debbie Stover, Senior Editor; High-Performance Composites Jul./Aug. 1994.

Combined Search and Examination Report dated Jun. 29, 2005 (5 pgs.).

GRAVITY VALVE FOR A DOWNHOLE TOOL

BACKGROUND OF THE INVENTION

1. Field of the Invention

This invention relates generally to downhole tools for drilling and completing subterranean wells and methods of using these tools; more particularly, this invention relates to downhole tools for selectively providing fluid communication therethrough, and methods of using those tools.

2. Description of Related Art

In many drilling, servicing, and completion applications, it becomes necessary to isolate particular zones within the well. When it is desired to completely plug a casing downhole, for example, a bridge plug may be utilized, such as those disclosed in U.S. Pat. application Ser. No. 10/658,979, entitled "Drillable Bridge Plug" by Lehr et al., incorporated by reference in its entirety herein, and assigned to the same assignee of the present application.

In some situations, it is desirable to provide a tool downhole, which allows fluid to flow in only one direction. For instance, when fracturing ("fracing") a well, it is desirable to provide fluid communication from the formation or reservoir to surface, while not permitting fluid to flow downwardly though the tool. In these systems, a frac plug is used. When treating a multi-zone formation, a lower zone may be treated; and a frac plug may be set above the lower zone. As the frac plug allows fluid flow in one direction only (upward), frac fluid may be pumped downhole to treat a second zone, which is above the frac plug. Once the pumping of the frac fluid ceases, production from the lower and upper zone may continue concomitantly. These steps may be repeated using additional frac plugs, depending upon the number of zones to be treated.

Cement retainers also are known to operate in a similar manner, in the reverse, allowing fluid (such as a cement slurry) to be pumped downhole; however, the cement retainer operates to prevent the cement or other fluids from flowing uphole through the tool. In short, frac plugs and cement retainers are known which have a one-way valve to selectively provide fluid communication through a downhole tool. Thus, a need exists for various downhole tools adapted to control the flow of flow of cement, gases, slurries, or other fluids through the downhole tool.

One prior art system for controlling the flow of fluid through a downhole tool is exemplified by the tool having packer on a hollow mandrel, the mandrel having an inner diameter which is not uniform. As shown in FIGS. 1 and 2, a point, the diameter of the mandrel 3 narrows with sloping sides to create a ball seat 2. The ball seat 2 may be located toward the upper end of the mandrel 1 as shown in FIG. 1, or on the lower end of the mandrel 3 as shown in FIG. 2. Resting within the ball seat 2 is a ball 1. The combination of the ball 1 resting in ball seat 2 results in the mandrel 3 having an internal ball valve that controls the flow of fluid through the downhole assembly. The valve provides fluid communication in one direction, that direction depending on the orientation of the components.

In some prior art systems, a sealing ball 1 may be dropped from surface once the mandrel is set downhole. When the ball 1 reaches and rests in seat 2, the valve prevents fluid from flowing downward. In other systems, to reduce the time required for closing the valve, the ball 1 is maintained in closer proximity to the seat 2, by a biasing means such as a spring, e.g. In other prior art system, the sealing ball is maintained proximate the ball seat by a pin or cage. Until a predetermined flow rate is achieved, the ball does not seat in the ball seat; once the predetermined flow rate is established (downwardly for a frac plug; upwardly for a cement retainer), the ball 1 rests in the ball seat 2 to prevent fluid flow therethrough.

In other prior art system, the ball and ball seat are inverted from the tool shown in FIGS. 1 and 2 such that the ball and ball seat act to allow fluid, such as a cement, slurry to be pumped from surface through the downhole tool and into the wellbore, but preventing the cement from returning to surface through the downhole tool.

In some instances, once the frac plugs or cement retainers have completed their function, the frac plugs and cement retainers are destructively removed. Once removed, two-way fluid communication is allowed in the wellbore.

When it is desired to remove these ball valves, a drill or mill may be used. Components of prior art ball valves, ball and ball seats, and caged ball designs can tend to rotate with the mill or drill bit upon removal. For example, it has been discovered that when the rotating element of the removal tool, such as the mill or drill bit, encounters the ball 1, the ball 1 will being to spin or rotate along with the mill or drill bit. The ball may begin to rotate at the same speed of the mill, the ball rotating within the ball seat. Thus, the ball begins to spin within the ball seat 2 thus hampering the milling or drilling operation. When this occurs, the removal time is increased; the operator at surface may have to raise and lower the mill or drill, change the speed of rotation, etc. These actions decrease the predictability of the removal time as well as increasing the removal times, thus further increasing the cost of the removal operation. It would therefore be desirable that the downhole tool provide relatively quick and predictable times for removal. Regarding removal, it is desirable that the downhole tool be capable of being removed with a motor on coiled tubing, as opposed to requiring a drilling rig. This minimizes the expense of the removal of the downhole tool.

In some situations, the prior art gravity valves of the downhole tool may operate at a less than optimum level, depending on the downhole fluid being used. For instance, if the density of the downhole fluid is significantly lower than that of the material of the ball, the ball valves operate in a sluggish fashion, staying closed longer than desired. Alternatively, if the density of downhole fluid approaches the density of the ball, the ball may tend to "float" excessively again Thus, it is desirable that the gravity valve be weighted so that the valve operates at an optimum level closes under the force of gravity even in high specific gravity fluids.

In addition, frac plugs and cement retainers may be exposed to significant pressures downhole. Excessive pressures on the prior art ball in the ball sleeve have been known to cause the ball and seat to leak or even break under the excessive pressure. Further, partially due to the spherical nature of the contact surface of the ball with the ball seat, prior art valves may tend to leak. Thus, it would be desirable to provide a more robust, easily removable downhole tool with improved sealing function, that is capable of operating at high pressures downhole.

The present invention is directed to overcoming, or at least reducing the effects of, one or more of the issues set forth above.

SUMMARY OF THE INVENTION

A gravity valve for use in composite frac plugs, traditional cast iron frac plugs, or other downhole tools is disclosed. In some embodiment, the gravity valve has components comprised of non-metallic materials; in some embodiments, the structure of the gravity valve is such that the components of the valve form a non-rotating lock to improve the removal of the tool.

In some embodiments, the geometry of the gravity valve is substantially non-spherical at the interface between the plunger of the valve and the valve seat, enabling rotational locking between the two parts. This is advantageous when it is desired to remove the gravity valve. This feature of the gravity valve facilitates the removal of the gravity valve such that the gravity valve may be milled with common downhole motors and carbide junk mills, usually deployed using coiled tubing. This design represents an improvement over traditional ball valves, ball and ball seats, or caged ball designs in that embodiments of the disclosed gravity valve resist rotation/spinning while being milled. Thus, removal time is decreased and predictability is improved.

In one embodiment, the gravity valve is used in a frac plug; in another, the gravity valve is utilized in a cement retainer. A gravity valve to control the flow of a downhole fluid through a downhole tool having a hollow mandrel is disclosed having a plunger within the mandrel, in which the plunger has an end with a substantially non-spherical surface. The seat of the mandrel may have a complementary substantially non-spherical surface adapted to selectively mate with the substantially non-spherical surface of the plunger to form a seal within the mandrel, rotation between the plunger and the seat being thereby precluded. Materials of construction for the gravity valve are disclosed, some being metal and some being non-metallic materials. Further a plurality of materials may be used to construct the plunger.

In some embodiments, the plunger is constructed from a material based on the relationship of the specific gravity of that material compared to the specific gravity of the downhole fluid. A downhole tool including a gravity valve is disclosed, as is a method of using and removing a downhole tool.

BRIEF DESCRIPTION OF THE DRAWINGS

The foregoing and other features and aspects of the invention will become further apparent upon reading the following detailed description and upon reference to the drawings in which.

Figure 1:
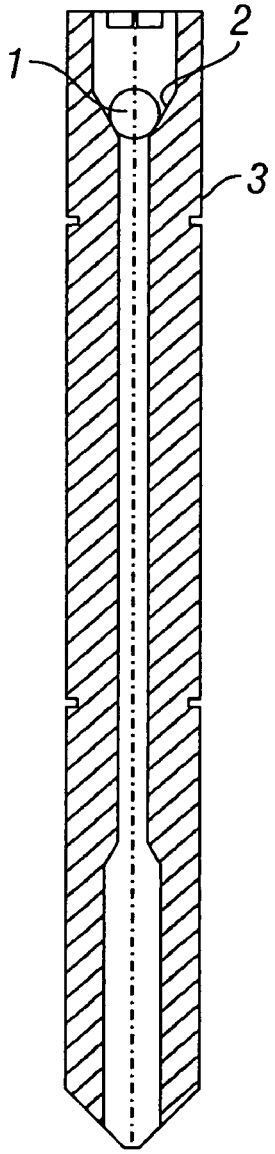
FIG. 1 (Prior Art)
FIG. 1 shows a mandrel of a prior art gravity valve having a ball and a ball seat.
Figure 2:
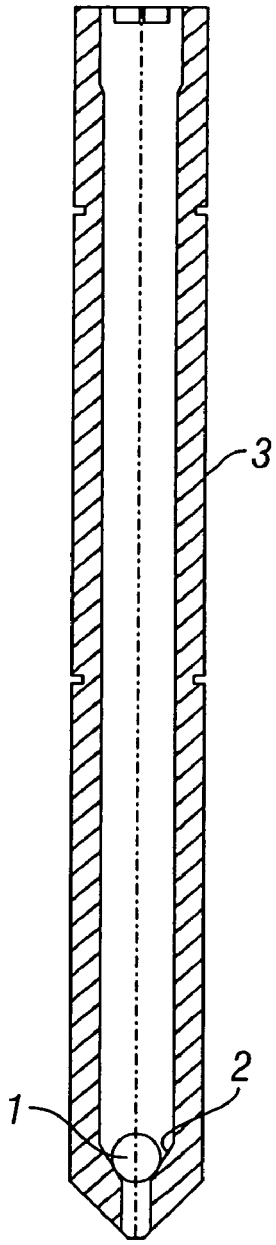
FIG. 2 (Prior Art)
FIG. 2 shows a mandrel of a prior art gravity valve with a ball and a ball seat, the gravity valve being located on the lower portion of the downhole tool.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DESCRIPTION OF ILLUSTRATIVE EMBODIMENTS

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, that will vary from one implementation to another. Moreover, it will be appreciated that such a development effort might be complex and time-consuming, but would nevertheless be a routine undertaking for those of ordinary skill in the art having the benefit of this disclosure.

Structure of Embodiments of a Gravity Valve

Figure 3A:
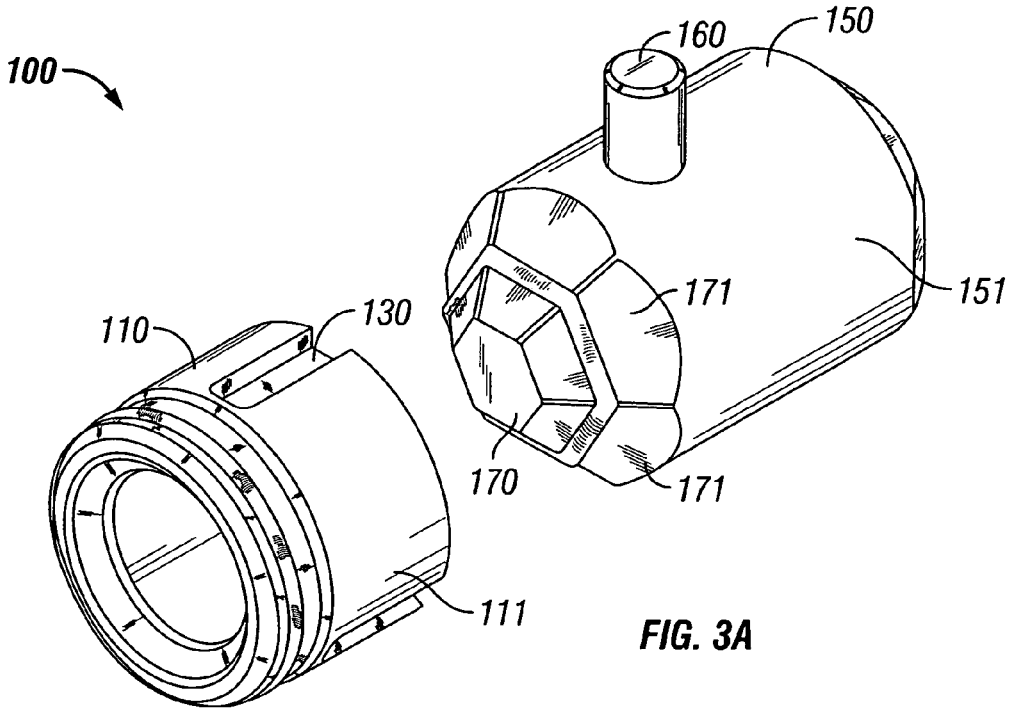
FIGS. 3A–3C show an embodiment of a gravity valve of the present invention having a plunger and a seat.
Figure 3B:
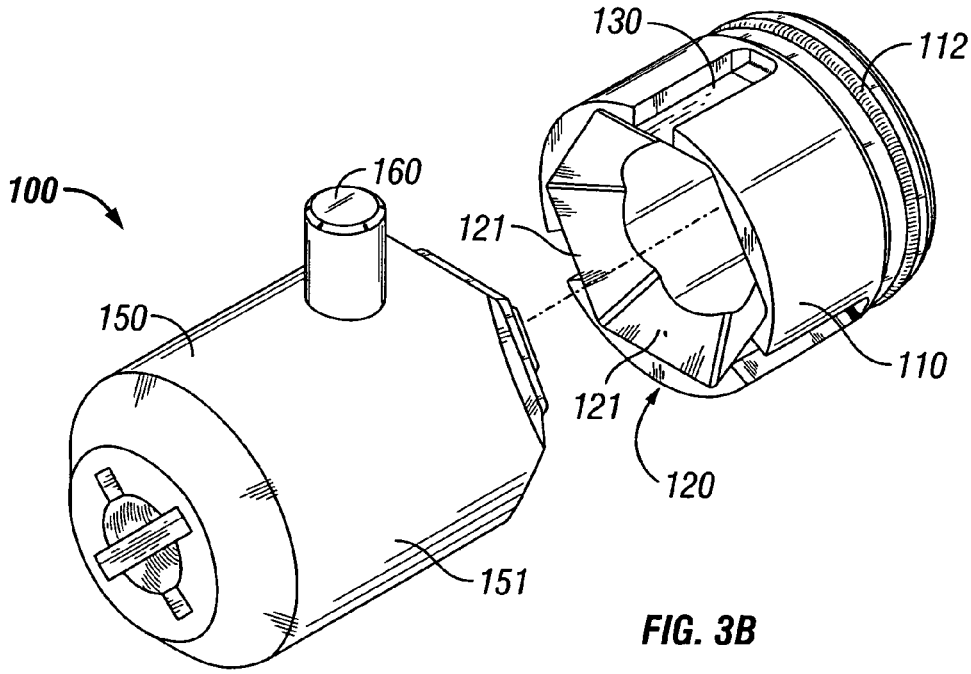
Figure 3C:
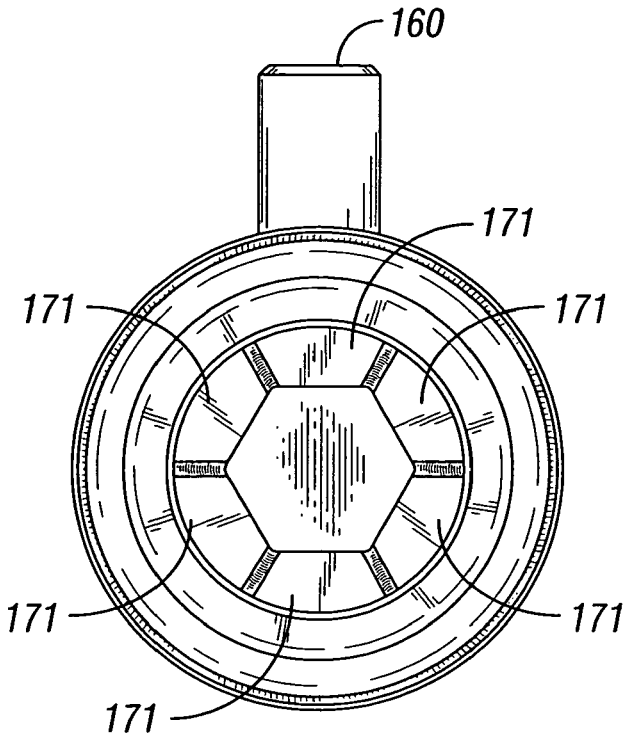

Referring to FIGS. 3A–3C, an embodiment of the present invention is shown as a gravity valve comprising a plunger 150 and a seat 110. In this embodiment, the plunger 150 has a nose or end 170 having a surface comprising a substantially non-spherical shape adapted to mate with a seat 110 having a complementary surface. This is in contrast to the prior art sealing balls, which contact the valve seat in a bearing or contact area having a substantially spherical shape. That is, the contact area between the seats and the prior art sealing balls or gravity valve balls is generally spherical (the ordinary meaning of "spherical" being defined as a shape that is bounded by a surface consisting of all points at a given distance from a point constituting its center). In this particular embodiment shown, the non-spherical surface of the nose end 170 is comprised of a plurality of faceted, planar faces 171. Shown on the outer perimeter 151 of the plunger 150 is a protrusion 160, such as a pin. In this embodiment, the outer perimeter 151 of the plunger 150 is circular.

Also shown in FIGS. 3A and 3B is seat 110 having an inner diameter 119 through which fluid may pass. The seat 110 is shown having an end 120 adapted to receive the nose or end 170 of the plunger 150. As shown in FIG. 3B, the end 120 of the seat 110 has a surface with a complementary, substantially non-spherical shape, adapted to selectively mate with substantially non-spherical surface on the nose or end 170 of the plunger 150. In the embodiment shown, the receiving end 120 has a substantially non-hemispherical surface comprised of a plurality of faceted, planar faces, which are complementary to the faceted planar faces 171 of the plunger 150 in this embodiment.

The seat 110 may have a substantially cylindrical perimeter 111. Also shown is a slot 130 at least partially through the outer perimeter 111 of the seat 110. Seat 110 may also comprise sealing means, such as o-ring 112 as described hereinafter. While FIGS. 3A and 3B showing perspective views of the plunger 150 and seat 110, FIG. 3C shows a top view of the plunger 150 of one embodiment of the present invention.

It should be mentioned that in the embodiments of FIGS. 3A–3C, the nose or end 170 of the plunger 150 is shown to be convex while the end 120 of the seat 110 is concave. However, this configuration is not required. For instance, the gravity valve (the operation of which is described hereinafter) may comprise a plunger 150 having its nose or end 170 being convcave, while the receiving end 120 of the seat 110 may be convex, as would be appreciated by one of ordinary skill in the art having the benefit of this disclosure.

Figure 4A:
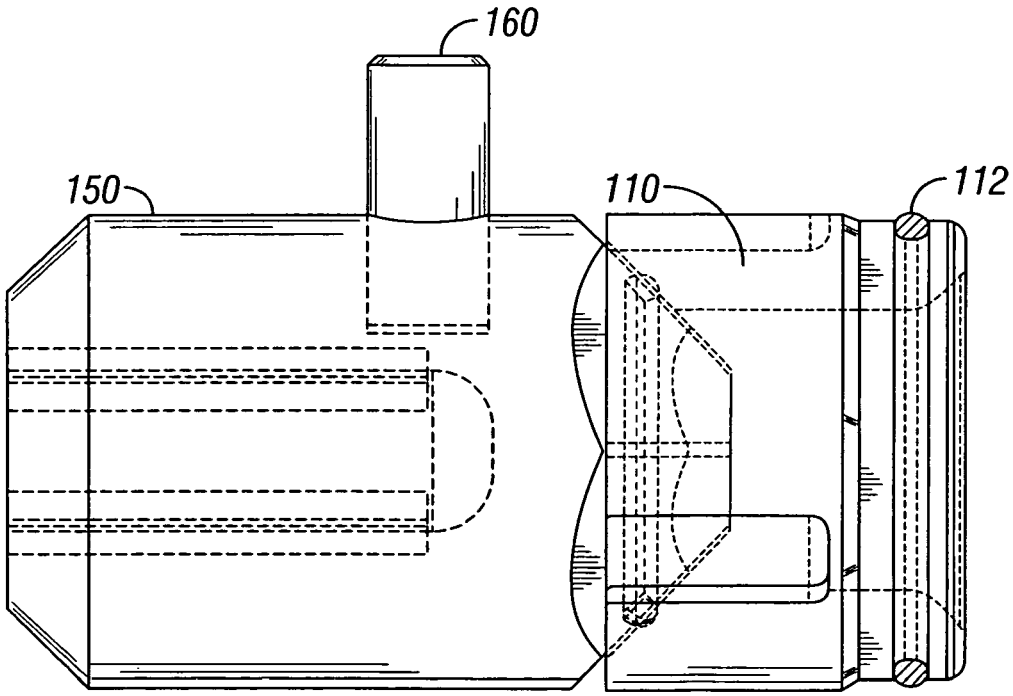
FIGS. 4A and 4B show an embodiment of the present invention in which the gravity valve is in a closed position, the plunger having a protrusion and a seat having a slot, each to selectively mate with the mandrel.

FIGS. 3A and 3B show the plunger 150 and the seat 110 not in contact, thus defining an open position for the gravity valve, as described more fully in the operation section. FIGS. 4A nd 4B show the plunger 150 in contact with the seat 110 to define a closed position of the gravity valve.

Figure 4B:
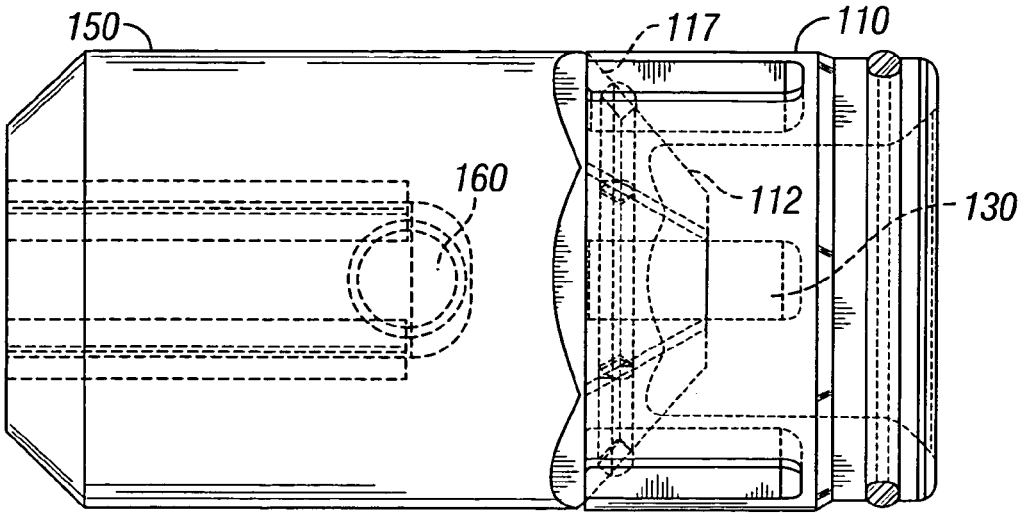

Referring now to FIGS. 4A and 4B, the plunger 150 of the gravity valve is received in the seat 110 thereby preventing fluid communication through the inner diameter of the seat 119, i.e. the plunger 150 seals or plugs seat 110 such that fluid communication through the inner diameter 119 is prevented, in this embodiment. As shown in FIGS. 4A and 4B, the faceted, planar faces 171 on the substantially non-spherical surface on an end 170 of the plunger 150 mate with the complementary faceted, planar faces 121 on the substantially non-spherical surface on an end 120 of the seal 110. Thus, fluid communication through the inner diameter 119 of the seat 110 is precluded. Partially because of the substantially non-spherical surface of the end 170 of the plunger 150 mating with the complementary surface on the seat 110, an improved seal is formed therebetween. This improved seal is at least partially the result of the increased mating surface area, in contrast to the gravity or sealing balls of prior art gravity valves.

The increased mating surface area provided by the substantially non-spherical surface on the end 170 of the plunger 150 mating with the complementary substantially non-spherical surface on end 120 on the seat 110 may provide additional advantages. For example, in high pressure situations, it is known that the prior art ball valves may leak, the contact surface being defined by a spherical surface or "line contact." The increased surface area of embodiments described herein thus provides an improved seal between the seat 110 and the plunger 150.

Further, if the pressure downhole is excessive, the ball or the seat of the prior art ball valves may even break. By distributing the force of the pressure over a larger surface area provided by the non-spherical mating surfaces, contact stress may be reduced on the components of the ball valve. Thus, the greater contact surface area provided by the substantially non-spherical mating surface of the plunger and the complementary surface of the seat may be advantageous in higher-pressure environments over the prior art ball valves having a spherical contact area.

Finally, when it is desired to remove the downhole tool, the substantially non-spherical contact area provides a non-rotational lock; as such, the plunger 150 may not tend to rotate with the mill, thus hastening the removal of the plunger.

Figure 5A:
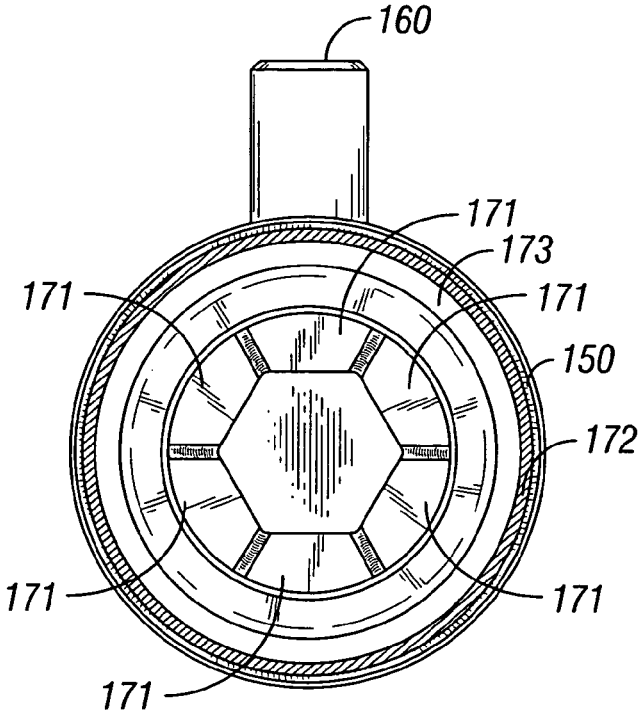
FIG. 5A shows an embodiment of a gravity valve of the present invention in which the plunger is comprised of more than one material.

Referring to FIG. 5A, an embodiment of the present invention is shown an embodiment of the present invention in which the plunger 150 is comprised of a plurality of materials, as described in greater detail hereinafter. One material 171 is shown comprising the outer surface of the plunger 150, while another material 173 is shown on an inner surface of the plunger 150.

Figure 5B:
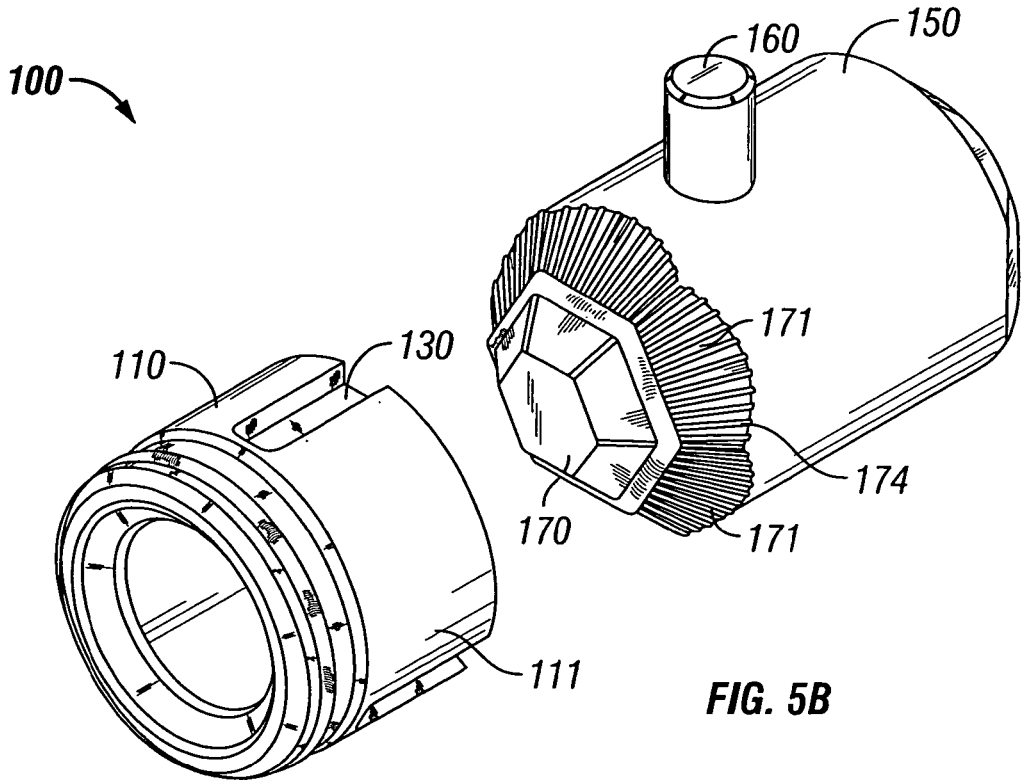
FIGS. 5B and 5C show an embodiment of the present invention in which planar faces on a faceted, non-spherical surface on an end of the plunger includes teeth or serrations adapted to mate with a complementary surface on the seat.
Figure 5C:
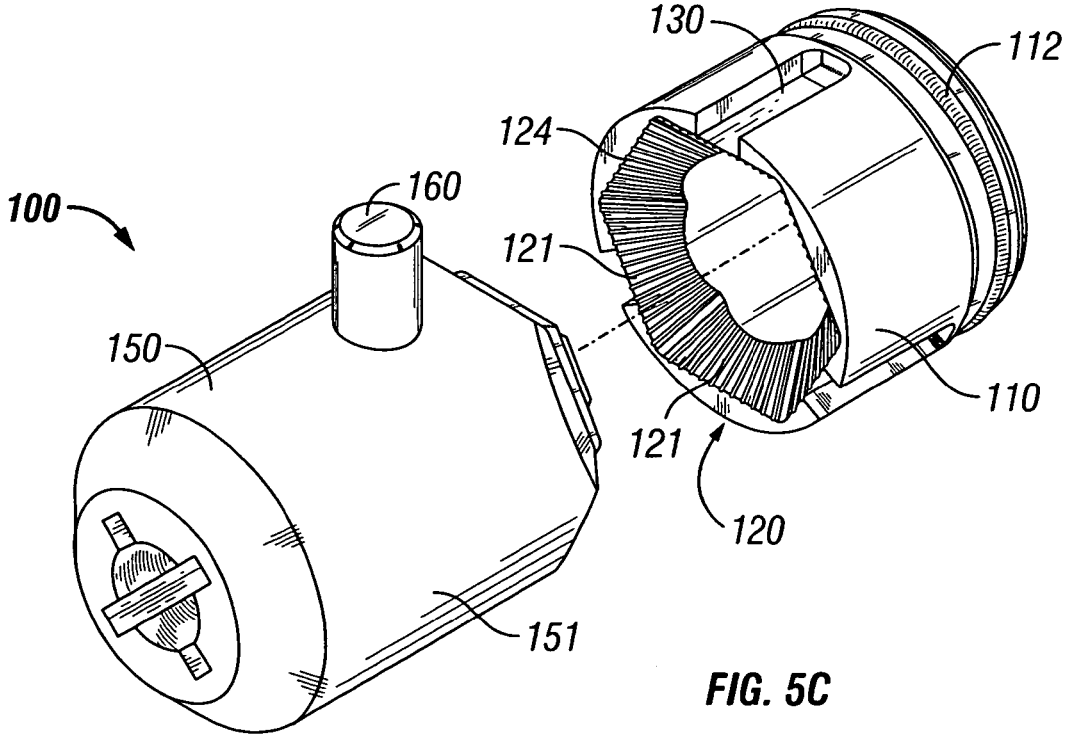

Referring to the FIGS. 5B and 5C, an embodiment of the present invention is shown in which the substantially non-spherical surface of the end 170 of the plunger 150 further comprises serrations 174 on the plurality of faceted, planar faces 171. As shown in FIG. 5C, the complementary substantially non-spherical surface of the end 120 of the seat 110 similarly may be comprised of complementary serrations 124 on the plurality of complementary faceted, planar faces 121. In operation, when the valve is closed, the serrations 174 of the plunger engage the complementary serrations 124 on the seat 110. The addition of the serrations 174 further increases the mating surface area between the plunger 150 and the seat 110, which may further act to reduce stress on the components of the gravity valve such as the plunger 150 and the seat 110. The increased mating surface area may further increase the non-rotational locking ability of the gravity valve, as well as increasing the seal between the plunger 150 and the seat 110.

Figure 5D:
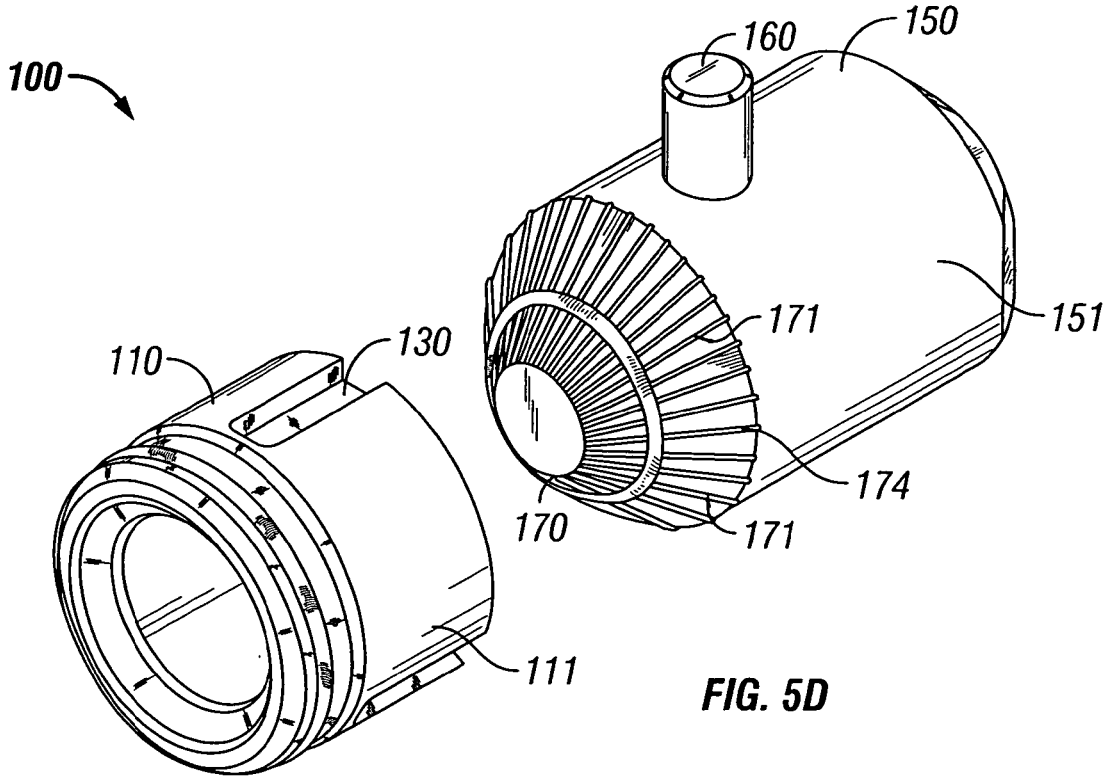
FIGS. 5D and 5E show an embodiment of the present invention in which the surface on the end of the plunger is non-spherical, as serrations or teeth are provided thereon to mate with complementary surface on the seat.
Figure 5E:
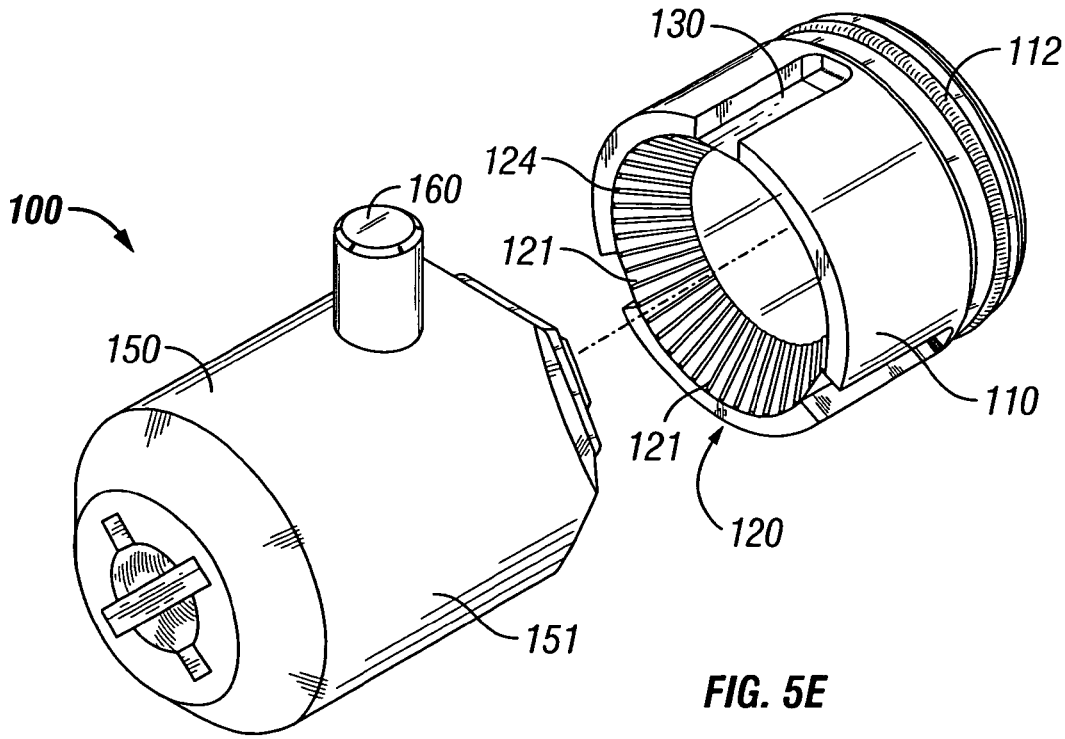

Referring to the FIGS. 5D and 5E, an embodiment of the present invention is shown in which the substantially non-spherical surface of the end 170 of the plunger 150 is comprised of serrations 174, the end 170 of the plunger not having the plurality of faceted, planar faces 171 of FIGS. 4B and C in this embodiment. As shown in FIG. 5E, the substantially non-spherical surface of the receiving end 120 of the seat 110 similarly may be comprised of complementary serrations 124. In operation, when the valve is closed, the serrations 174 of the plunger 150 engage the complementary serrations 124 on the seat 110. The addition of the serrations 174 further increases the mating surface area between the plunger 150 and the seat 110, which may further act to reduce stress on the components of the gravity valve such as the plunger 150 and the seat 110. The increased mating surface area may further increase the non-rotational locking ability of the gravity valve, as well as improving the seal between the plunger 150 and the seat 110.

Figure 6A:
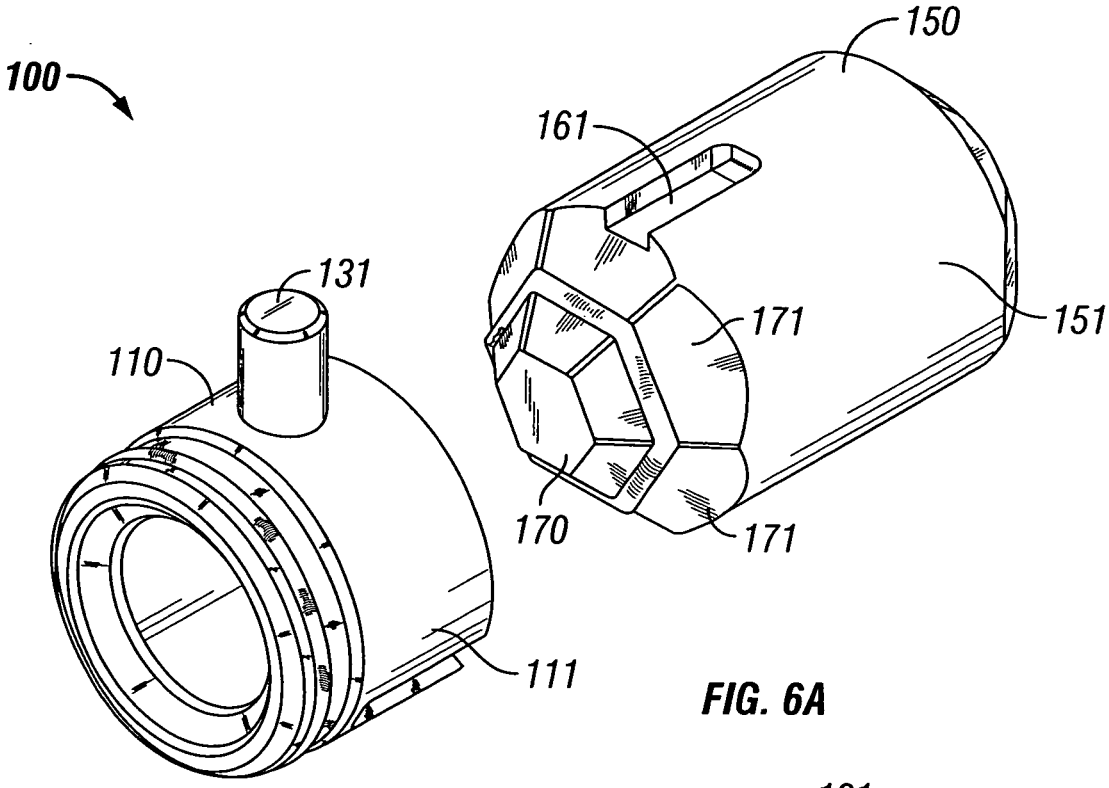
FIGS. 6A and 6B show an embodiment of the present invention in which the gravity valve is in an open position, the plunger having a slot and the seat having a protrusion, each adapted to mate with the mandrel.
Figure 6B:
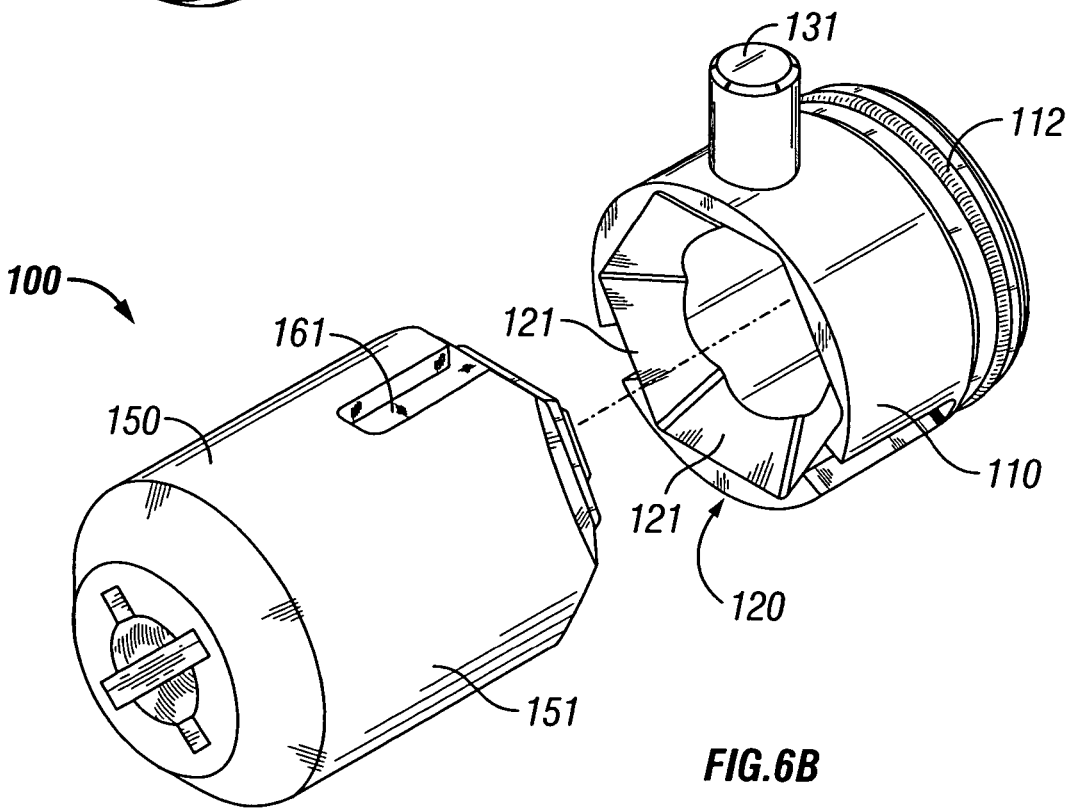

Referring to FIGS. 6A and 6B, another embodiment of the present invention is shown in which the seat 110 further comprises a protrusion 131 to mate with a slot in the mandrel as described hereinafter, while the plunger 150 has a slot 161 adapted to mate with a slot in the mandrel. The protrusion received in a slot of the mandrel, or the protrusion in the mandrel extending into a slot in the plunger 150 or seat 110 prevents rotation with respect to the mandrel, thereby defining a means of preventing rotation with the mandrel.

Figure 7:
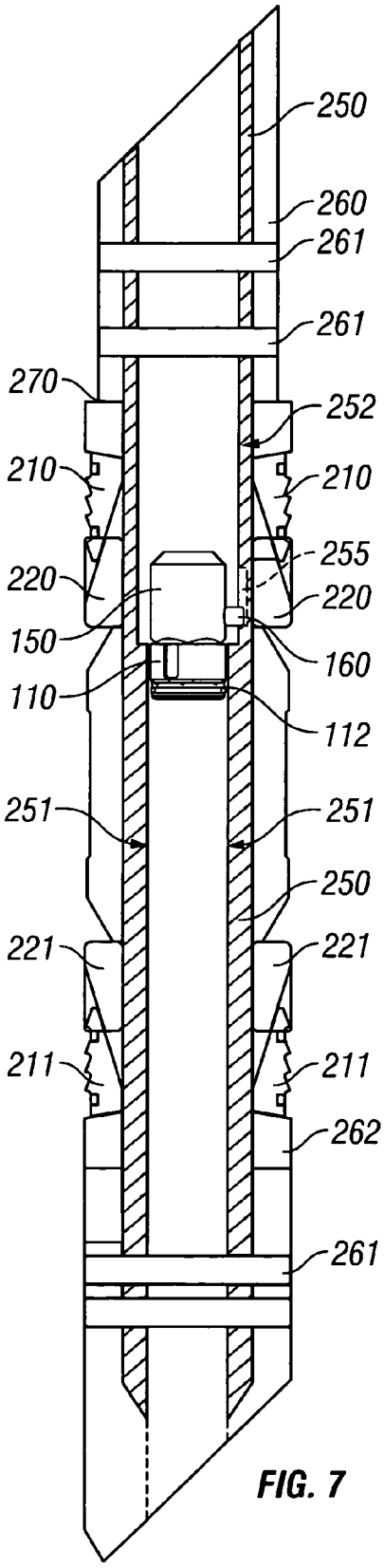
FIG. 7 shown an embodiment of the present invention in which the gravity valve is adapted for use in a downhole tool such as a frac plug.

While these feature further improves the non-rotational locking mechanism thus facilitating removal of the tool, the slot 161 in the plunger mating with a protrusion in the mandrel (or the protrusion 160 on the plunger 150 and a slot in the mandrel of FIGS. 4A and 7) performs another function of preventing rotation of the plunger 150 when the valve is in the open position. Thus, the substantially non-spherical surface of the end 170 of plunger 150 will be aligned to properly selectively mate with the complementary surfaces of the seat 110. Further, the protrusion on the mandrel mating with a slot in the plunger 150 (or the protrusion 160 on the plunger 150 mating with a slot 255 of FIG. 7) also acts to limit the axial travel of the plunger 150 as described more fully hereinafter.

Composition of Embodiments of a Gravity Valve

Various types of fluids are encountered downhole. The density of any of these downhole fluids may vary considerably. Thus, the downhole fluids used in conjunction with the gravity valve may have vastly differing specific gravities (specific gravity being density of the fluid/density of water, also known as relative density). Examples are provided below in Table 1:

TABLE 1

Density and Specific Gravity for Exemplary Downhole Fluids

| Material | Density lbs./in.$^3$ | Specific Gravity (dimensionless) |
|---|---|---|
| Cement | 0.071 | 1.96 |
| Drilling Mud | 0.052 | 1.44 |
| Water | 0.036 | 1 |
| Frac Fluid | 0.050 | 1.4 |
| 15% HCl Acid | 0.039 | 1.075 |

It is desirable that the gravity valve of the present invention be capable of optimal operation for different downhole fluids.

As stated previously, the prior art ball valves may be typically comprised of cast iron. Such a material may allow the ball valve to operate in a sufficient manner when used in conjunction with some downhole fluids, but not in others. Thus, one object of the present invention is to customize the plunger weight so that the plunger closes under the force of gravity even in high specific gravity fluids.

Further, the materials that may be utilized in the construction of the plunger of the gravity valve disclosed herein may have various specific gravities, as shown in Table 2.

TABLE 2

Density and Specific Gravity for Exemplary Materials for Gravity Valve Components

| Material | Density lbs./in.$^3$ | Specific Gravity (dimensionless) |
|---|---|---|
| Cast Iron | 0.261 (7.28 gm/cm$^3$) | 7.30 |
| Phenolic resins | 0.050–0.124 | 1.4–3.45 |
| Unfilled PPS | 0.048 | 1.35 |
| Unfilled PEEK | 0.047 | 1.32 |
| 40% Carbon-Reinforced PEEK | 0.053 | 1.48 |
| Lead | 0.410 | 11.40 |
| Bismuth | 0.353 | 9.83 |
| Antimony | 0.238 | 6.64 |
| Brass | 0.30 | 8.33 |

It has been discovered that when the specific gravity of the plunger approximates the specific gravity of the fluid passing through the valve, the gravity valve operation is optimized. The optimum specific gravity of the plunger is slightly greater than that of the fluid being used downhole. Thus, when the specific gravity of the working fluid is 1.0, it is desirable that the specific gravity of the material of the plunger be, e.g., between 1 and 1.2% for a frac plug, and 0.8–1.0 for a cement retainer. The operation of the gravity valve is also dependent upon the operating pressures, etc. By utilizing the above formula, the plunger for the gravity valve may be tailored for optimal performance for a particular application For example, a fracturing fluid with a weight of 13.6 pounds per gallon (ppg) has a specific gravity (S.G.) of 1.63. Therefore, a gravity valve can be constructed so as to not float in the fluid if the plunger has a specific gravity between 1.63 and 1.95 (1.2×1.63).

In some embodiments, the plunger 150 of the gravity valve may be comprised of cast iron. In others, the plunger 150 may be comprised of entirely non-metallic material, e.g. a single type of plastic or composite. In some embodiments, the plunger 150 may be comprised of a type of thermoset plastic, such as phenolic. The plunger 150 may also be comprised of a carbon-reinforced PPS or PEEK, or PEKK material may be used, as well as a glass fiber reinforced PPS. Lastly, reinforcing fibers in a bi-directional form, such as those found in a resin impregnated sheet molding materials, available from suppliers such as Cytec Engineered Materials of West Paterson, New Jersey, can also be used. In short, any material known to one of ordinary in the art having the benefit of this disclosure, which can withstand the operating pressure to which the plunger is to be exposed, and which may be shaped into the desired structure of the plunger 150, may be utilized. Further, the materials mentioned above may also be desirable, in that they may be more easily milled (and thus facilitate the removal of the plunger 150) than other materials.

In some situations, it may not be possible to achieve the desired relationship between the specific gravity of the fluid being used to the specific gravity of the plunger, by using only one material of construction for the plunger. Thus, it is sometime desirous to construct the plunger of a plurality of materials. In these situations, the "average density" of the entire plunger may be utilized, such that the average density relates to the density of the downhole fluid being used. In these cases, the average density may be determined by dividing the combined weights of the plunger materials used by the volume of the plunger. As stated above, it is desirable in some instances that the average density be substantially within 20% of the specific gravity of the downhole fluid. E.g., using the previous example of the fracturing fluid having an S.G. of 1.63, and referring to the tables of materials properties, a gravity valve plunger could be constructed such that is approximately 95% unfilled PPS and 5% brass, to yield a plunger with an equivalent S.G. of 1.70.

In some embodiments, the plunger 150 of the gravity valve may be comprised of a plurality of materials. The selection of materials may be based on the desired average specific gravity of the resulting plunger 150. For instance, referring back to FIG. 5A, the outer surface of the plunger 160 may be comprised of one of the non-metallic materials mentioned above, while the inner diameter 173 of the plunger 150 may comprise a higher density material, such as a metal. The metal may be a soft, low melting temperature metal such as lead, bismuth, or antimony, for example. Using these metals, the average specific gravity of the plunger 150 may be varied, providing more flexibility for the user and improved performance of the gravity valve of the downhole tool.

To manufacture the gravity valve of FIG. 5A utilizing two different materials, the plunger 150 may be cast in two steps: one for the material of the outer surface 172, and one for the inner surface 173. Or the inner diameter may be machined away from the original plunger, and the second material molded in place. Further, a plastic or composite material could be injection molded over a denser, higher melting temperature material such as brass. Of course, the gravity valve may be constructed of more than two different materials, to achieve the desired specific gravity.

Referring back to FIG. 5A, another embodiment of the present invention is shown in which the plunger 150 is comprised of a plurality of materials. The plunger 150 may comprise of an outer shell or surface 173 of harder, higher density plastic or composite material and an inner mass or surface 172 of lower density plastic, composite, or metallic material. Using this approach, the specific gravity of the plunger 150 for the gravity valve can be tailored to work in a variety of downhole fluids, the objective being to customer weight the valve so that it closes under the force of gravity even in high specific gravity fluids., or floats to close when used in an injection application.

When the specific gravity of the plunger 150 being designed as outline above for use with a fluid of known specific gravity, then the biasing means of the prior art ball valves is superfluous, the valve operating optimally on its own. It should be noted, however, that use of a biasing means such as a spring is not precluded by utilizing the gravity valve disclosed herein. For instance, in horizontal or highly deviated wells, a biasing means such as a spring may be utilized to bias the plunger toward the gravity valve seat (i.e. biasing the plunger substantially downwardly in a frac valve embodiment, and to bias the plunger substantially upwardly in a cement retainer embodiment).

Regarding the construction of the seat 110 of the gravity valve, it should be noted that the composition of the seat 110 may be any material suitable to withstand the downhole pressure the seat 110 will experience. For instance, cast iron may be utilized, as may any metallic or non-metallic material mentioned above, or a combination thereof. Or the composition of the seat 110 may be of the same material of the plunger 110 used in a given operation. The specific gravity of the material of composition for the plunger 150 may affect the operation the valve 400 more than that of the material for the seat 110, as the seat 110 is attachable to the mandrel 250. Thus, the selection of the material for composition of the seat 110 may be less critical than that of the plunger 150, in some situations. Further, the composition of the seat 110 may correspond to the composition of the plunger 150, described above.

Operation of Embodiments of a Gravity Valve

FIG. 7 shows a downhole tool of one embodiment of the present invention, which utilizes and embodiment of the disclosed gravity valve. In the embodiment shown, the tool may operate as a frac plug. The general components of the downhole tool are described as follows. A mandrel 250 is surrounded packing element 230, which may be comprised of one or multiple elastomeric elements, and may include a booster ring. The upper end of the packing element abuts upper cone 220 and the lower end abuts lower cone 221. Abutting each cone are upper and lower slip assemblies 210 and 211, which abut caps 260, 262. Caps 260, 262 are secured to the mandrel by pins 261 (not shown).

In this embodiment, the mandrel 250 is hollow and comprises a circular cross-section. The gravity valve of one embodiment of the present invention is shown within the mandrel 250. The plunger 150 is disposed above the seat 110 in this embodiment.

The gravity valve is shown disposed in the mandrel of the downhole tool. In this embodiment, the plunger 150 is disposed above the seat 110 within the mandrel, such that the downhole tool is adapted to operate as a frac plug 300. The protrusion 160 of the plunger 150 is adapted to engage the slot 255 in the mandrel 250 as shown. As can be seen, the plunger 150 is free to move upwardly the length of the slot 255 in the mandrel 250. Other means for limiting the axial movement of the plunger 150 may be utilized, as described above, to prevent to plunger from being lifted to surface. The protrusion 160 further operates to engage the slot 255 in the mandrel so that relative rotation is precluded when the valve is open. Thus, the substantially non-spherical surface of the plunger 150 will be in proper alignment with the complementary surface of the seat 110.

Operation and setting of downhole tool of FIG. 7 is as follows. The frac plug 300 is attached to a release stud (not shown) and run into the hole via a wireline adapter kit (not shown). Once lowered in the wellbore to the desired setting position, a setting sleeve (not shown) supplies a downhole force on upper push ring 270 while an upward force is applied on the mandrel 250. The upper slips 210 ride up upper cone 220 to engage the casing wall in the wellbore. As the mandrel 250 continues to be pulled up hole, the packer 230 begins its radial outward movement into sealing engagement with the casing wall. As the setting force from the setting sleeve (not shown) increases and the elastomeric portion 48 of packing element 410 is compressed, the lowers slips 211 traverse lower cone 221 until the slips engage the casing wall. The release stud breaks, thereby leaving the set frac plug in the wellbore.

In the frac plug assembly 300 shown in FIG. 7, the mandrel 250 includes an inner diameter which is not uniform. The mandrel has a larger diameter 252 above the gravity valve 400, which reduces to a smaller inner diameter 251 below the gravity valve 400. The valve 400 controls the flow of fluid through the frac plug assembly 300.

The seat 110 may be fixed to the smaller inner diameter 251 of the mandrel 250 by any means known to one of ordinary skill in the art having the benefit of this disclosure, such as via threaded engagement, for example. The o-ring 112 may provide sealing engagement between the seat 110 and the inner diameter 251 of the mandrel 250.

As would be appreciated by one of ordinary skill in the art having the benefit of this disclosure, the gravity valve 400 allows fluid to flow from downhole to surface, while concomitantly preventing fluid to flow from surface to the reservoir downhole. Thus, after the frac plug 300 is set, frac fluid may be pumped downhole to stimulate a zone above the frac plug 30. Once the stimulation is complete, then production from below the frac plug to surface may continue.

As shown in FIG. 7, the gravity valve 400 is in the closed position, the substantially non-spherical surfaces on the end or nose 170 of the plunger 150 mating with complementary substantially non-spherical receiving surface of the seat 110. In this position, fluid from surface to the area below the gravity valve 400 is prevented. The mating non-spherical surfaces of the plunger 150 and the seat 110 are adapted to prevent fluid flow through the valve, and the o-ring 112 is adapted to prevent fluid flow around the seat 110 and between the seat 110 the inner diameter of the mandrel 251.

In some situations, an upward force is generated due to pressure from the formation, e.g., acting to force fluid upward from the formation or reservoir. When this upward force is great enough to overcome gravity to lift the plunger 150 from the seat 110, the gravity valve 400 will open. In the open position, fluid flow uphole through the gravity valve 400 is permitted, as a gap exists around the outer perimeter 151 of the plunger 150 and the larger inner diameter of the mandrel 252.

In some embodiments, the distance the plunger 150 may move upwardly within the mandrel is limited such that the plunger will not flow to surface with the fluid. In the embodiment shown, the protrusion 160 extending into the slot 255 in the mandrel 250 limits the upward movement of the plunger 150. Any other method of limiting the upward movement of the plunger 150, such as having a cage or pin uphole, known to one of ordinary skill in the art having the benefit of this disclosure may be utilized. In some embodiments, it is desirable to prelude relative rotation between the plunger 150 and the seat 110 when the gravity valve 400 is in the open position. For instance, this may improve the seal between the plunger 150 and the seat 110 because the non-spherical surfaces are always in proper alignment (e.g. planar face 171 of the plunger 150 being directly above the complementary planar face 121 of the seat 100 at all times), and may further improve the operation of the frac plug 300. In these embodiments, the substantially non-spherical surface of the plunger 150 and the complementary surface on the seat 110 would not necessarily have to be self-aligning. In the embodiment shown in FIG. 7, the protrusion 160 engaging the slot 255 of the mandrel accomplishes this function, inter alia.

As stated above, when the specific gravity of the plunger 150 is substantially 1 to 1.2 times that of the specific gravity of the fluid, such as the frac fluid in this example, operations of the frac plug 300 is optimized.

When it is desired to remove the frac plug, the end cap 260, cones 220, 221, slips 210, 211, and packing element 230 may be milled with a standard mill being rotated by a motor on the end of coiled tubing. When the mill encounters the plunger 150, rotation relative to the mandrel is precluded by at least two means in this embodiment. First, the protrusion 160 on the plunger 160 is inserted into the slot 255 of the mandrel 250. Second, and more importantly, with the gravity valve 400 in the closed position, the non-spherical mating surfaces of the plunger 150 mate with the complementary non-spherical surfaces of the seat 110. As the mill contacts the plunger 150, the mating of the non-spherical surfaces also acts to prevent relative rotation therebetween. Thus, removal of the gravity valve is facilitated. This feature allows a simple junk mill on coiled tubing to be utilized, instead of utilizing a more expensive drilling rig.

Figure 8:
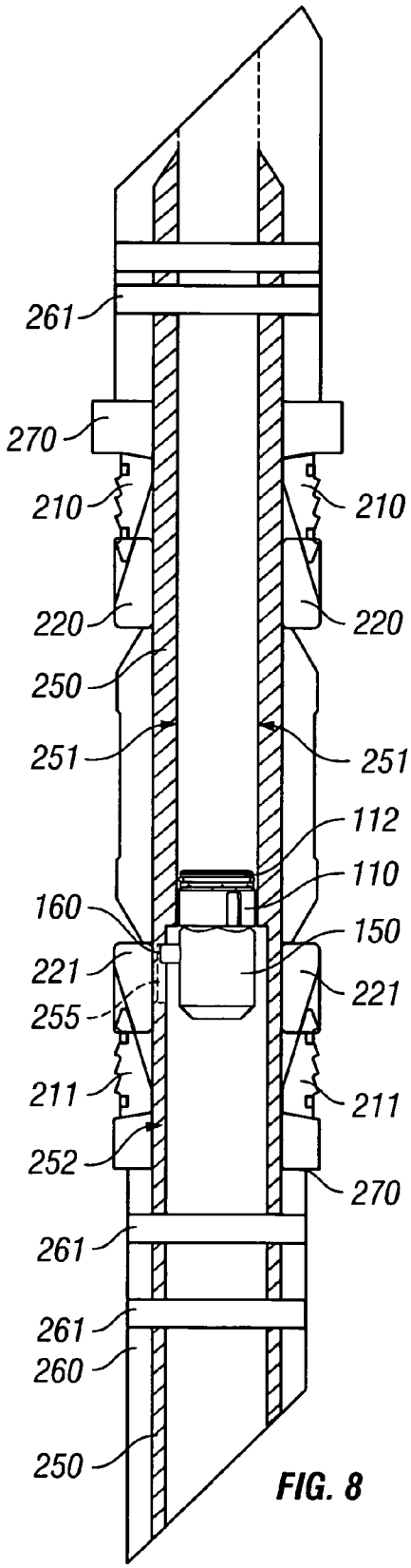
FIG. 8 shows an embodiment of the present invention in which the gravity valve is adapted for use in a downhole tool as a cement retainer.

Referring to FIG. 8, the downhole tool is shown as a cement retainer 200. The components shown are generally those of the frac plug 300 of FIG. 7, with the downhole tool being inverted from that of the FIG. 7. The structure and operation of the mandrel 250, packer 230, cones 220. 221, slip assemblies 210, 211, and end caps 260, 262 are identical to that discussed with respect to the frac plug of FIG. 7. However, in the embodiment of FIG. 8, the gravity valve 400 is inverted. That is, the plunger 150 is disposed within the mandrel 250 below the seat 110.

Thus, in this configuration, the downhole tool comprises a cement retainer 200, such that the fluid flow from surface downhole through the gravity valve 400 is allowed, but fluid from the formation or reservoir to surface is precluded by the buoyancy of the gravity valve 400.

Generally, the force of gravity will prevent the plunger 150 from contacting the seat 110. Thus, the gravity valve 400 will be in an open position allowing fluid flow from surface, through the smaller inner diameter 251 of the mandrel 250, through the seat 110, and around the outer perimeter 151 of the plunger 150 into the larger outer diameter 252 of the mandrel 250, continuing downhole. The downward movement of the plunger 150 may be limited so that the plunger 150 is not lost downhole. For instance, the protrusion 160 on the plunger 150 may mate with a slot 255 on the mandrel 250, the length of the slot determining the extend of downward movement of the plunger 150 is allowed to travel. Alternatively, a pin may reside in the mandrel to engage a slot in the plunger 150, as described with respect to FIGS. 6A and 6B, to limited the downward movement of the plunger. In short, any other means of limiting the downward movement of the plunger 150, such as having a cage or pin downhole, known to one of ordinary skill in the art having the benefit of this disclosure may be utilized. Again, the seat 110 may be fixedly attached to the inner diameter 251 of the mandrel, and an o-ring 112 may provide additional sealing engagement therebetween.

Further, when cement is being pumped downhole, the force of the fluid flow of the cement further acts to apply a downward pressure on the plunger 150.

In some situations, when the pumping of cement ceases, an upward pressure is generated from pressure downhole. When this upward or buoyant force is great enough to overcome gravity, the plunger 150 will move from its lowermost position. When this force is great enough, the plunger 150 will contact seat 110, thus closing the gravity valve 400. In the closed position, the substantially non-spherical surface on the nose or end 170 of the plunger 150 mates with the complementary non-spherical surface on the end 120 of the seat 110, to close the gravity valve 150. In the closed position, fluid flow uphole through the gravity valve 400 is precluded.

In some embodiments, it is desirable to preclude relative rotation between the plunger 150 and the seat 110 when the gravity valve 400 is in the open position. For instance, this may improve the seal between the plunger 150 and the seat 110 because the non-spherical surfaces are always in proper alignment. In the embodiment shown in FIG. 8, the protrusion 160 of the plunger engaging the slot 255 of the mandrel 250 accomplishes this function, inter alia.

As stated above, when the specific gravity of the plunger 150 is less than the specific gravity of the fluid such as cement, operation of the gravity valve 400 in the cement retainer 200 is optimized.

When it is desired to remove the cement retainer 200, the end caps 260, 262, cones 220, 21, slips 210, 211, and packing element 230 may be milled with a standard mill being rotated by a motor on the end of coiled tubing. When the mill encounters the plunger 150, rotation relative to the mandrel is precluded, as the protrusion 160 on the plunger 160 is inserted into the slot 255 of the mandrel 250 thus precluding relative rotation therebetween. Thus, removal of the gravity valve is facilitated.

While the invention may be adaptable to various modifications and alternative forms, specific embodiments have been shown by way of example and described herein. However, it should be understood that the invention is not intended to be limited to the particular forms disclosed. Rather, the invention is to cover all modifications, equivalents, and alternatives falling within the spirit and scope of the invention as defined by the appended claims. Moreover, the different aspects of the disclosed methods and apparatus may be utilized in various combinations and/or independently. Thus the invention is not limited to only those combinations shown herein, but rather may include other combinations. For example, the disclosed invention is also applicable to any permanent or retrievable tool for controlling fluid flow therethrough, utilizing the advantage of the non-spherical mating surfaces of the gravity valve, and selecting the materials composition of the gravity valve in light of the specific gravity of the fluids downhole, disclosed therein; the invention is not limited to the preferred embodiments.

The following table lists the description and the numbers as used herein and in the drawings attached hereto.

| Number | Description |
|---|---|
| 1 | Ball (Prior Art) |
| 2 | Ball Seat (Prior Art) |
| 3 | Hollow Mandrel |
| 100 | Gravity Valve |
| 110 | Seat of Gravity Valve |
| 111 | Perimeter of Seat |
| 112 | O-ring |
| 119 | Inner diameter of Seat |
| 120 | Receiving End of Seat (substantially non-spherical) |
| 121 | Complementary Faceted, Planar Face |
| 124 | Serrations |
| 150 | Plunger of Gravity Valve |
| 151 | Perimeter of Plunger |
| 160 | Protrusion |
| 170 | Nose or End of Plunger (substantially non-spherical) |
| 171 | Faceted, Planar Face |
| 172 | One material for Plunger |
| 173 | Second Material for Plunger |
| 174 | Serrations |
| 200 | Cement Retainer |
| 210 | Upper Slips |
| 211 | Lower Slips |
| 220 | Upper Cone |
| 221 | Lower Cone |
| 250 | Mandrel |
| 251 | Smaller Inner Diameter of Mandrel |
| 252 | Larger Inner Diameter of Mandrel |
| 255 | Slot in Mandrel |
| 260 | End Cap |
| 261 | Pins |
| 262 | Lower End Cap |
| 270 | Push Ring |
| 300 | Frac Plug |
| 400 | Cement Retainer |

What is claimed is:

1. A gravity valve to control the flow of a downhole fluid through a downhole tool having a hollow mandrel, comprising:

a plunger within the mandrel having an end with a substantially non-spherical surface; and a seat within the mandrel having a complementary substantially non-spherical surface adapted to selectively mate with the substantially non-spherical surface of the plunger to form a seal within the mandrel, rotation between the plunger and the seat being thereby precluder, the valve selectively moving from an open position to a closed position to selectively control the flow of fluid through the downhole tool.

2. The valve of claim 1, in which the gravity valve is in the closed position precluding fluid communication through the mandrel when the substantially non-spherical surface of the plunger mates with the complementary substantially non-spherical surface of the seat, the valve defining the open position allowing fluid communication through the mandrel when the plunger and the seat are not in contact.

3. The valve of claim 1, in which tbe substantially non-spherical surface of the end of the plunger comprises a faceted surface having a plurality of planar faces, the complementary surface of the seat having a plurality of complementary planar faces, the planar faces of the plunger adapted to selectively mate with each of the planar faces of seat to form a seal.

4. The valve of claim 3, in which the plurality of planar faces on the plunger further comprise serrations adapted to mate with complementary serrations on the complementary planar faces of the seat.

5. The valve of claim 1 in which the substantially non-spherical surface of the plunger comprises serrations, the complementary surface of the seat comprising complementary serrations adapted to mate with the serrations of the plunger when the valve is in a closed position.

6. The gravity valve of claim 1 in which the plunger is comprised of metallic material.

7. The gravity valve of claim 1, in which the plunger is comprised of non-metallic material.

8. The gravity valve of claim 7, in which the non-metallic material is composite or plastic.

9. The gravity valve of claim 7 in which the non-metallic material is carbon-reinforced PEEK, PPS, phenolic, or PEKK.

10. The gravity valve of claim 1 in which the plunger is comprised of a material having a specific gravity which is less than of a specific gravity of the downhole fluid.

11. The gravity value of claim 10 in which the specific gravity of the material of the plunger is substantially 0.8–1.0 times the specific gravity of the downhole fluid.

12. The gravity valve of claim 1 in which the plunger is comprised of a material having a specific gravity which is greater than the specific gravity of the downhole fluid.

13. The gravity valve of claim 12 in which the specific gravity of the material of the plunger is substantially 1.0–1.2 times the specific gravity of the downhole fluid.

14. The gravity valve of claim 1 further comprising a biasing means adapted to bias the plunger toward the seat.

15. The gravity valve of claim 1, in which the plunger is comprised of a plurality of materials, each material having a different specific gravity.

16. The gravity valve of claim 1, in which the plunger further comprises:

an outer surface comprised of a first material; and an inner surface comprised of a second material having a different specific gravity than the first material.

17. The gravity valve of claim 16, in which the first material is non-metallic, and the second material is antimony, lead, or bismuth.

18. The gravity valve of claim 16, in which the first and second materials are selected such that an average specific gravity of the plunger is greater than a specific gravity of the downhole fluid.

19. The gravity valve of claim 16 in which the first and second materials are selected such that an average specific gravity of the plunger is less than a specific gravity of the downhole fluid.

20. The gravity valve of claim 1, in which the plunger further comprises a protrusion on its perimeter adapted to mate with a slot on an inner diameter of the hollow mandrel, the protrusion mating with the slot in the mandrel to limit relative axial movement between the plunger and the mandrel.

21. The gravity valve of claim 1, further comprising means for limiting the axial movement between the plunger and the mandrel.

22. The gravity valve of claim 1, in which the seat further comprises an o-ring on the perimeter of the seat to provide sealing engagement with the inner diameter of the mandrel.

23. The gravity valve of claim 1, in which the seat comprises means for rotationally locking to the mandrel.

24. The gravity valve of claim 1, in which the plunger comprises means for rotationally locking to the mandrel.

25. The gravity valve of claim 1, in which the seat is disposed within the mandrel above the plunger in the mandrel, such that the gravity valve operates to allow fluid to flow from surface downhole through the mandrel, the gravity valve preventing fluid communication from downhole to surface.

26. The gravity valve of claim 1, in which the seat is disposed below the plunger in the mandrel, such that the gravity valve operates to prevent fluid to flow from surface downhole through the mandrel, the gravity valve allowing fluid communication from downhole to surface.

27. A downhole tool for selectively providing communication of a downhole fluid between surface and downhole, comprising:

a hollow mandrel having an inner diameter;

a packer disposed around the mandrel;

an upper plurality of slips abutting an upper cone;

a lower plurality of slips abutting a lower cone; and a gravity valve within the inner diameter of the mandrel having a plunger and a seat, the gravity valve adapted to prevent fluid communication therethrough the mandrel when an outer surface of the plunger mates with a complementary surface of the seat defining in a closed position, the gravity valve adapted to allow fluid communication through the mandrel when the plunger and seat are not in contact defining an open position,the vaule selectively moving from the open position and the closed position to selectively control the flow of fluid through the downhole tool.

28. The downhole tool of claim 27 in which the plunger is comprised of a material having a specific gravity less than of the specific gravity of the downhole fluid.

29. A method of selectively providing fluid communication through a mandrel of a downhole tool, comprising:

setting in a casing a downhole tool having gravity valve within a hollow mandrel;

preventing fluid communication in one direction when a substantially non-spherical surface of a plunger within the mandrel contacts a complementary non-spherical surface of a seat;

allowing fluid communication in another direction when the plunger does not contact the seat;

moving selectively the gravity value from an open position to a close position to selectively control the flow of fluid through the mandrel of the downhole tool; and milling the downhole tool from the casing, the plunger of the gravity valve adapted to remain rotationally locked to the seat during the milling operation.

30. The method of claim 29, further comprising:

determining a specific gravity of the downhole fluid;

constructing the plunger of the value gravity of a material such that the specific gravity of the plunger is less than a specific gravity of the downhole fluid.

31. The method of claim 29, further comprising:

determining a specific gravity of the downhole fluid;

constructing the plunger of the gravity valve of a material such that the specific gravity of the plunger is greater than a specific gravity of the downhole fluid.

* * * * *

UNITED STATES PATENT AND TRADEMARK OFFICE

CERTIFICATE OF CORRECTION

PATENT NO. : 7,163,066 B2
APPLICATION NO. : 10/841797
DATED : January 16, 2007
INVENTOR(S) : Douglas J. Lehr It is certified that error appears in the above-identified patent and that said Letters Patent is hereby corrected as shown below:

Col. 13, in Claim 1, line 46-47, change “precluder” to --precluded--.

Col. 13, in Claim 3, line 57, change “tbe” to --the--.

Col. 16, in Claim 29, line 12, change “close” to --closed--.

Signed and Sealed this

Twentieth Day of March, 2007

JON W. DUDAS
*Director of the United States Patent and Trademark Office*